United States Patent [19]
Morenus et al.
[11] 4,452,124
[45] Jun. 5, 1984

[54] STABILIZING TAB FOR MISSILE LAUNCHER

[75] Inventors: Richard C. Morenus, Long Beach; John T. Moore, Orange, both of Calif.

[73] Assignee: Ford Aerospace & Communications Corporation, Detroit, Mich.

[21] Appl. No.: 473,929

[22] Filed: Mar. 10, 1983

[51] Int. Cl.[3] ..... F41F 3/04
[52] U.S. Cl. ..... 89/1.816; 89/1.703
[58] Field of Search ..... 89/1.816, 1.819, 1.8, 89/1.818, 1.703, 1.7, 14 C

[56] References Cited

U.S. PATENT DOCUMENTS

| | | | |
|---|---|---|---|
| 1,380,358 | 6/1921 | Cooke | 89/1.703 |
| 2,787,938 | 4/1957 | Bach | 89/1.816 |
| 3,225,655 | 12/1965 | Inglis | 89/1.816 |
| 3,412,640 | 11/1968 | Nash | 89/1.816 X |
| 3,548,707 | 12/1970 | Hughes | 89/1.8 |
| 3,946,639 | 3/1976 | Sanvito et al. | 89/1.816 X |
| 4,044,648 | 8/1977 | Piesik | 89/1.8 |
| 4,106,389 | 8/1978 | Walley | 89/1.816 X |
| 4,327,624 | 5/1982 | Piesik | 89/1.816 |
| 4,404,887 | 9/1983 | Piesik | 89/1.816 |

FOREIGN PATENT DOCUMENTS

| | | | |
|---|---|---|---|
| 2030038 | 12/1971 | Fed. Rep. of Germany | 89/1.816 |
| 89970 | 8/1937 | Sweden | 89/1.816 |

*Primary Examiner*—David H. Brown
*Attorney, Agent, or Firm*—Edward J. Radlo; Robert D. Sanborn

[57] ABSTRACT

A launch tube (2) for launching a missile (4) is supported by a single base (6) which enables the tube (2) to pivot about orthogonal yaw and pitch axes. An aerodynamic stabilizing trim tab (20) is positioned within the interior rear of the launch tube (2). During launch, exhaust gases from the missile (4) flow over the trim tab (20), producing a lift torque which balances the torque about the pitch axis caused by gravity acting upon the missile (4). This gravitational torque would otherwise tend to pull the nose of the launch tube (2) increasingly downward as the missile (4) is launched. The angle of incidence of the trim tab (20), its surface area, and its distance from the pitch axis are varied to adjust the lift torque and the drag attributable to the trim tab (20). The drag is used to balance forward frictional force upon the launch tube (2) caused by the motion of the missile (4). The pitch torques and the linear forces are balanced simultaneously.

8 Claims, 8 Drawing Figures

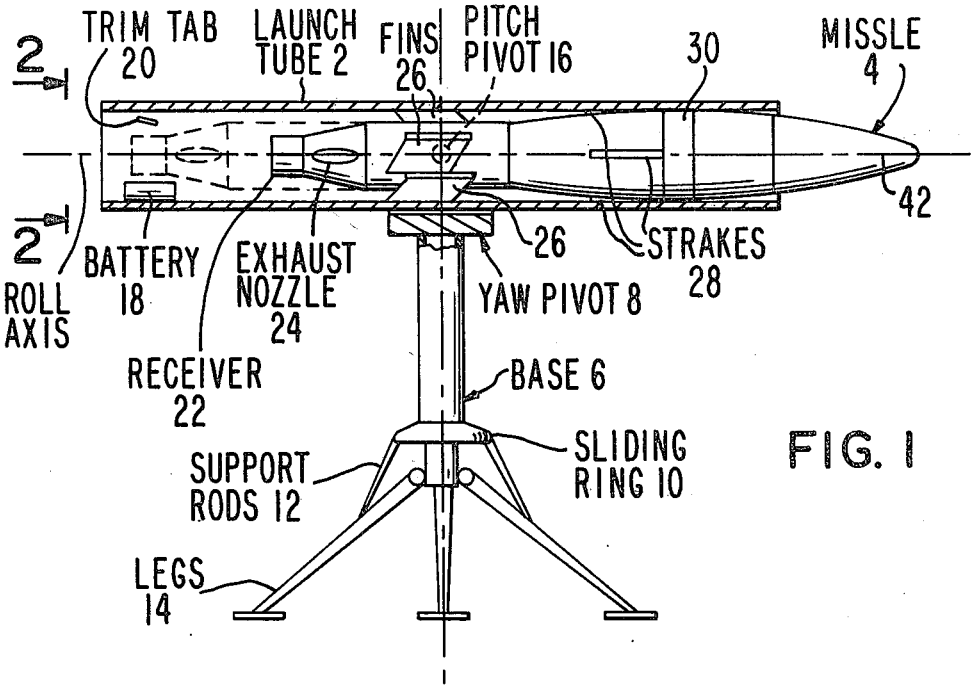
FIG. 1
FIG. 2
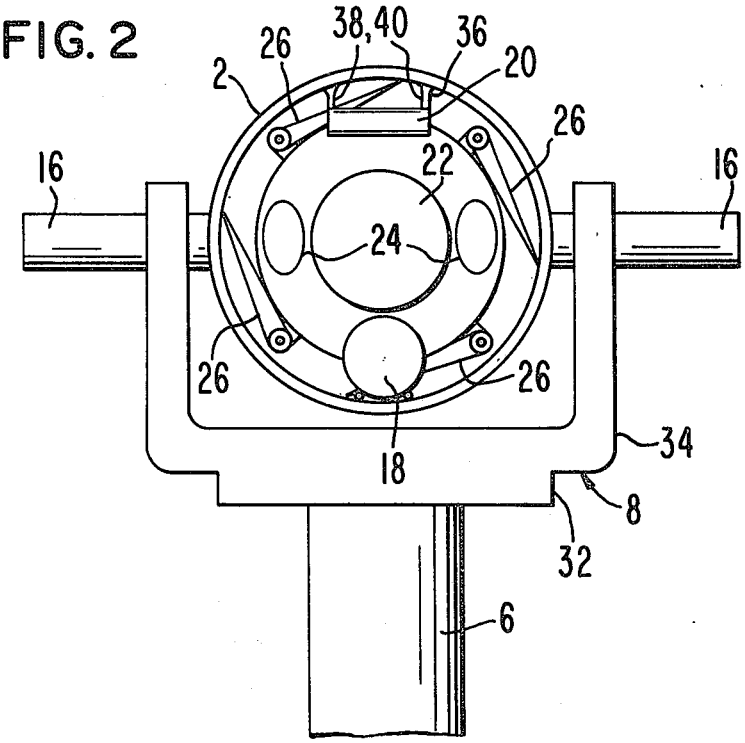

STABILIZING TAB FOR MISSILE LAUNCHER

TECHNICAL FIELD

This invention pertains to means for stabilizing launch tubes that launch missiles.

BACKGROUND ART

A search through the public records of the U.S. Patent and Trademark Office disclosed the following four U.S. patent references:

U.S. Pat. No. 1,380,358 is relevant to that portion of the present invention which stabilizes the launch tube (2) along its longitudinal (roll) axis. Forward muzzle deflectors 4, outwardly diverging tubular deflector 2, and springs 27 of the reference balance recoil. Recoil is not a problem in the present invention because the launch tube (2) is open ended, not close ended.

U.S. Pat. No. 2,787,938 shows frusto-conical closure element 28 for opening a launch tube to prevent damage due to exhaust gases and to avoid recoil. Element 28 does not counteract undesired torques, as does trim tab 20 in the present invention.

U.S. Pat. No. 3,548,707 counteracts torque about the roll axis of a missile fired from a rifled gun tube launcher. Rotation about the roll axis is not a problem in the present invention, which addresses linear displacements along the roll axis and torques about the pitch axis of the launch tube (2).

U.S. Pat. No. 4,044,648 shows doors (76, 78) which act as check valves to allow multiple launch tubes to exhaust into a common plenum while preventing exhaust products from damaging unfired adjacent missiles.

DISCLOSURE OF INVENTION

The present invention addresses the problem of stabilizing a launch tube (2) which is supported by a single base (6). Such an apparatus can be used, for example, by ground troops, who require a lightweight portable missile (4) launcher. Such a launch tube (2) pivots about two axes, a pitch (i.e., elevation) axis and a vertical yaw axis, to facilitate aiming the missile (4) at its target. During launch, gravitational force acting upon missile (4) causes a torque about the pitch axis, tending to pull down the nose (i.e., the front, the right hand side in FIG. 1) of the tube (2). This nose-down torque becomes a maximum as the missile (4) reaches the front of the launch tube (2). Additionally, the forward movement of the missile (4) within the tube (2) creates a forward force along the launch tube (2) due to friction between the missile (4) and the tube (2).

This invention counters these unwanted perturbations by using an aerodynamic trim tab (20) within the rear of tube (2). Exhaust gases and induced flow from the missile rocket nozzles (24) exert a force on the trim tab (20) which causes a torque about the pitch axis to counter-balance the gravitational torque about this axis, and a rearward force which, along with forces on other components within the launch tube (2) such as battery (18), simultaneously counter-balances the forward friction force.

BRIEF DESCRIPTION OF THE DRAWINGS

These and other more detailed and specific objects and features of the present invention are more fully disclosed in the following specification, reference being had to the accompanying drawings, in which:

FIG. 1 is a side view of launch tube 2 containing missile 4 in the process of being launched, with that half of tube 2 closest to the viewer being broken off to permit the viewing therewithin;

FIG. 2 is an end view of tube 2 taken from the left of FIG. 1;

DETAILED DESCRIPTION OF THE PREFERRED EMBODIMENTS

Figure 3:
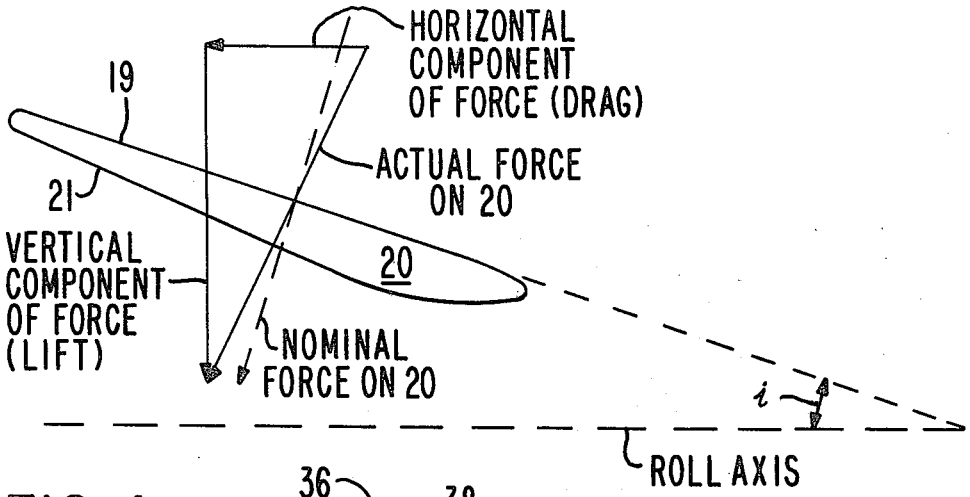
FIG. 3 is a detailed view of trim tab 20 viewed from the same direction as in FIG. 1.

FIG. 1 shows that launch tube 2 containing missile 4 pivots about two axes (pitch and yaw) and has a single base 6. The longitudinal axis of missile 4 is aligned with the longitudinal axis of tube 2, and is also known as the roll axis. In the prelaunch state, the roll axis is nominally horizontal with respect to ground. The elevation axis, also known as the pitch axis, is orthogonal to the page in FIG. 1 and preferably intersects the roll axis at the center of mass of each of launch tube 2 and missile 4 when the latter is in its prelaunch stationary state. The yaw axis is vertical with respect to ground, is orthogonal to the pitch axis, is orthogonal to the roll axis in the prelaunch stationary state, is generally aligned with the centerline of base 6, and preferably but not necessarily intersects the pitch axis.

A pitch pivot 16 mounted on the outside of tube 2 permits partial rotation of tube 2 about the pitch axis. A yaw pivot 8 situated at the top of base 6 permits partial or complete rotation of tube 2 about the yaw axis. Thus, pivots 16 and 8 provide the human operator with a good deal of freedom in aiming missile 4 at various targets.

Base 6 supports tube 2 at a single point, typically at the center of mass of each of the launch tube 2 and prelaunched missile 4. Base 6 is shown here having tripod legs 14 which are extended by means of sliding ring 10 and support rods 12; however, any conventional means for forming base 6 could be employed. For example, base 6 could be the shoulder of a foot soldier.

Launch tube 2 has a generally elongated cylindrical hollow shape, is open at both ends, and is nominally horizontal during prelaunch. At the rear (left in FIG. 1) of tube 2 can be mounted launch support equipment which, in this example for purposes of illustration only, comprises thermal battery 18.

Missile 4 has a generally elongated cylindrical shape. The solid lines for missile 4 in FIG. 1 show missile 4 partway propelled within launch tube 2, a few milliseconds after ignition of missile 4's propulsion rockets. The dotted lines in FIG. 1 indicate the initial prelaunch position of missile 4 within launch tube 2.

Missile 4 comprises nose 42; a wide portion 30 which substantially fills the entire inner diameter of launch tube 2; and a portion to the rear of wide portion 30 which does not fill the entire inner diameter of launch tube 2, but which has along the periphery of its frontmost region a set of bore riding strakes 28 which do extend to the inner diameter of tube 2, thereby providing the stabilization advantage of a full diameter while retaining the weight savings advantage of a less than full diameter for this region.

A set of hinged fins 26 is shown disposed about the periphery of a rear portion of missile 4. In this contracted, hinged position, fins 26 exert a negligible outward force on the inner diameter of tube 2. Fins 26 deploy to an extended position following the exit of missile 4 from tube 2 to provide stabilization for missile 4 during its flight.

Two rocket exhaust nozzles 24 are shown at a rear region of missile 4, disposed along the periphery of the body of missile 4 for expelling exhaust gases from the missile's rockets. For purposes of illustration only, an infrared laser receiver 22 is shown at the extreme rear of missile 4 and serves to receive post-launch guiding signals from a corresponding transmitter based in tube 2. The invention is not limited to any particular type of missile, such as the laser guided missile illustrated herein. At the rear bottom of launch tube 2 is shown generally cylindrical thermal battery 18, which provides power for the aforementioned laser transmitter, a viewing system, or other devices. Although the Figures illustrate battery 18, it is possible that this battery is not present or, alternatively, another device or devices are present in lieu of battery 18.

Aerodynamic stabilizing trim tab 20 is typically situated within a rear portion of tube 2 and serves to counter-balance gravitational torques about the pitch axis as well as frictional forces along the roll axis, as will be described in more detail below. Tab 20 is offset from the roll axis, because it is desired for its full effectiveness to be felt gradually, not immediately, after missile 4 launch; in this case, tab 20 is situated in a top region of tube 2 because battery 18 is situated in a bottom region.

FIG. 2, an end view of the rear of tube 2, shows that trim tab 20 is suspended from the top inner wall of tube 2 by means of spread bonding 36 which provides maximum mechanical support of trim tab 20 while allowing a large open area above trim tab 20 to retain its aerodynamic effectiveness.

Yaw pivot 8 comprises a generally cylindrical sleeve portion 32, which fits over generally cylindrical base 6. A bearing may be present between sleeve 32 and base 6 to reduce the friction therebetween. Mounted on top of sleeve 32, preferably as an integral part thereof, is U-shaped trunnion 34, which supports pitch pivot 16 comprising two horizontal axles aligned along the pitch axis. Axles 16 are rigidly affixed to the outer periphery of tube 2 and may be extended outwardly therefrom to form handlebars, thus providing a ready means for the operator to pivot tube 2 about the pitch and yaw axes. Axles 16 should be free to rotate within the cylindrical openings provided therefor within trunnion 34; thus bearings can be utilized. Alternatively or in addition to bearings, viscous dampers can be employed at the axle 16/trunnion 34 interfaces to aid in the horizontal prelaunch and postlaunch stabilization of tube 2.

FIG. 3 shows that trim tab 20 has substantially the shape of an airfoil so as to maximize lift (vertical component of force from exhaust gases acting thereon) while minimizing drag (horizontal component of force from exhaust gases acting thereon). Thus, trim tab 20 has a substantially flat upper surface 19 and a curved lower surface 21 with typically, although not necessarily, greater thickness at its front than at its rear. Direct blasts and secondary induced flows produced by the gases leaving exhaust nozzles 24 produce a force on trim tab 20 which is nominally perpendicular to upper surface 19 as illustrated by the dotted vector in FIG. 3. The actual force is usually not quite perpendicular to upper surface 19, and is illustrated by the solid slanting vector. The vertical component of this force (lift) is used to balance the gravitational torque about the pitch axis, while the horizontal component of this force (drag) is used as part of the compensation for the friction forces, as described in more detail hereinbelow.

The angle between the upper surface 19 and the roll axis is designated the angle of incidence i of trim tab 20. A suitable range for i is between 5° and 25° inclusive. The lift is roughly proportional to (i) cos (i) over this range, while the drag is roughly proportional to (i) sin (i) over this range. Thus, it is seen that adjusting the angle i has an important effect upon both lift and drag. Other important adjustable parameters are the surface area of surface 19 (both lift and drag are proportional to this area) and the distance between trim tab 20 and the pitch axis (the torque about pitch provided by tab 20 is proportional to this distance; the onset, but not the amplitude, of drag is also related to this distance).

Figure 4:
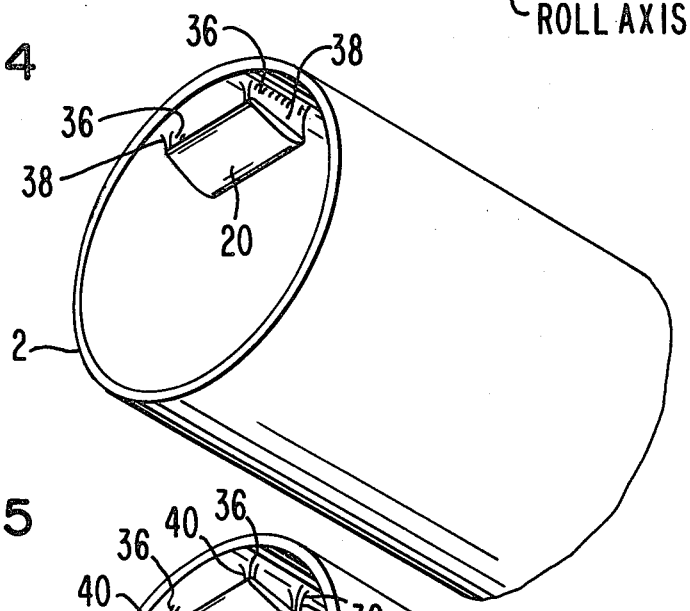
FIG. 4 shows trim tab 20 viewed from the bottom rear of tube 2 looking up.
Figure 5:
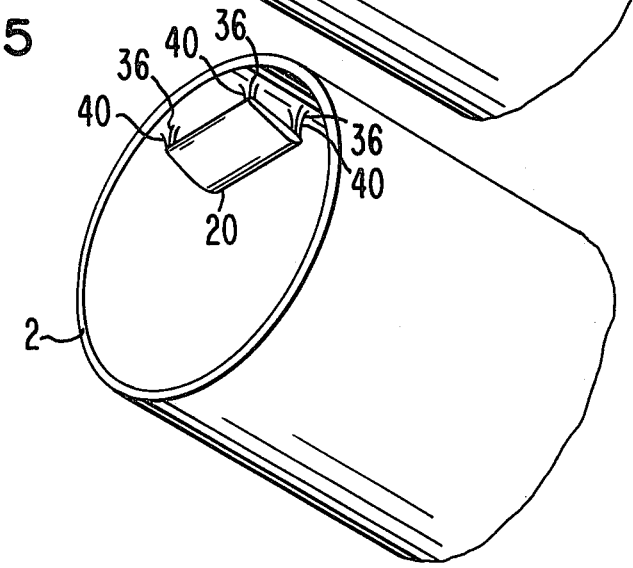
FIG. 5 shows an alternative embodiment for supporting trim tab 20, viewed from the bottom rear of tube 2 looking up.

FIGS. 4 and 5 illustrate two alternative embodiments for affixing trim tab 20 to the upper wall of tube 2. Each of these figures shows tab 20 from below looking up into the rear of tube 2. In FIG. 4, two trapezoidal plates 38 support tab 20 and are each continuously bonded via a bond 36 along one edge to tube 2 and along an opposing edge to tab 20. In FIG. 5, four support posts 40 are each bonded via a bond 36 at one end to tube 2 and at an opposing end to tab 20. The two frontmost posts 40 can be adjustably affixed to tab 20, as by a nut-and-screw arrangement, to permit the fine-tuning of angle i in the field; in this case, the two rear posts 40 are hingedly affixed to tab 20. Alternatively, the rear posts 40 are adjustable and the front posts 40 are hinged.

Figure 6:
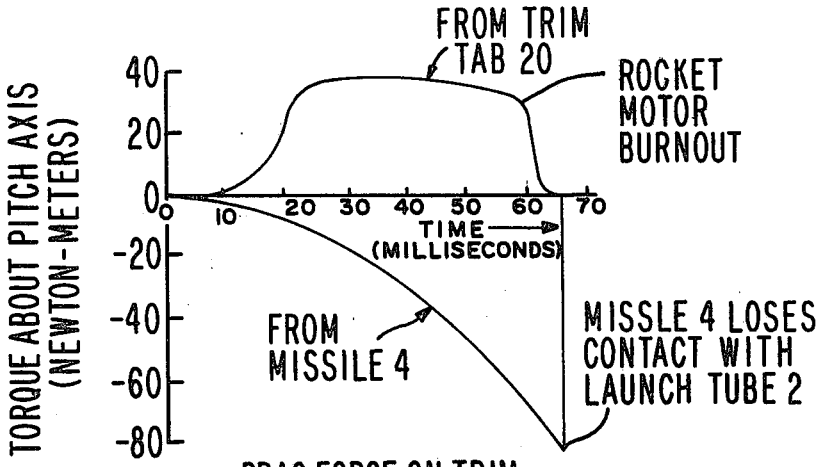
FIG. 6 is a graph showing the two torques about the pitch axis over time for a typical launch scenario.

FIG. 6 illustrates the torques about the pitch axis produced by gravity acting upon missile 4 as it moves along tube 2, and by the lift on trim tab 20 during launch as a function of time. Angle i, the area of surface 19, and the distance of tab 20 from the pitch axis have been selected, based upon missile 4 weight and tube 2 length, so that the integrals under the two curves of FIG. 6 are equal and of opposite sign. When missile 4 first starts to move, there is little force on tab 20 because the exhaust passes directly out of tube 2 and has not spread enough to encompass roll-axis-offset tab 20. By the time missile 4 has moved forward about the distance of one diameter of tube 2, the gas flow chokes at the rear of missile 4, producing a fairly uniform high subsonic flow that moves over tab 20 and out the rear of tube 2.

It is also desirable to make the two FIG. 6 integrals as equal as possible for all intermediate times during the launch. The torque attributable to tab 20 must, however, fall to zero before the torque due to gravity 4 because the rockets must be shut off before missile 4 leaves tube 2 so as to protect the human operator, and tab 20 stops providing lift almost immediately after these rockets are shut down.

Figure 7:
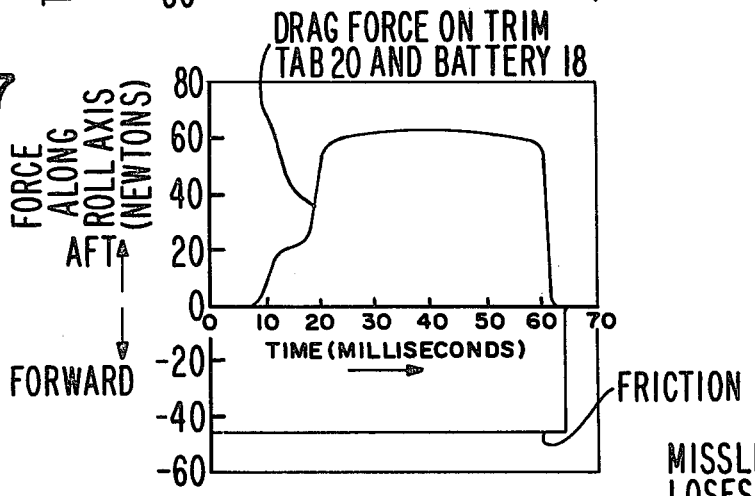
FIG. 7 is a graph showing the two forces that are parallel to the roll axis over time for the scenario of FIG. 6.

FIG. 7 illustrates that the principal forces along the roll axis acting on tube 2 are friction between missile 4 and tube 2 which pulls tube 2 forward, and the rearward forces on tube 2 from the action of the exhaust gases on tab 20 and battery 18. It is desirable, simultaneous with the balancing of torques described above, to equalize these forces to avoid a disruptive rocking motion of tube 2 along the roll axis. Thus, it is desirable to equalize the opposite-signed integrals under the two curves illustrated in FIG. 7. It is also generally desirable to equalize these integrals for any point in time during the launch process; however, as with the torques illustrated in FIG. 6, the rearward forces stop almost as soon as the rocket motors stop firing. Thus, the upper curve returns to zero before the lower curve. As with the lift, the drag attributable to tab 20 can be adjusted by adjusting angle i, the area of surface 19, and the distance of tab 20 from the pitch axis. The aerodynamic efficiency (lift to drag ratio) of tab 20 is normally deliberately reduced to produce enough drag to help in balancing the forward frictional forces.

A good estimate of launch motion can be obtained by ignoring coupling between tube 2 and base 6, and by assuming that missile 4 remains in contact with tube 2 throughout the launch. With these assumptions, the rate of change of angular momentum is set equal to the external torques as follows:

$$d/(dt)(Iq) = -mgx + M_t$$

where:

the nose-up direction is taken to be positive;

I is the moment of inertia about the pitch axis of the combined missile 4 and tube 2 and is equal to the initial moment of inertia of the combined missile 4/tube 2 plus $mx^2$;

q is the pitch rate of the combined missile 4/tube 2, i.e., the rate of change with respect to time of angle j, the angle between the roll axis and the local horizontal;

m is the mass of missile 4;

g is gravitational acceleration;

$M_t$ is the torque about the pitch axis attributable to tab 20; and x is the distance between the pitch axis and the center of mass of missile 4. Assuming that the center of mass of missile 4 is aligned with the pitch axis prior to launch, it is the distance missile 4 has moved forward during the launch process.

Figure 8:
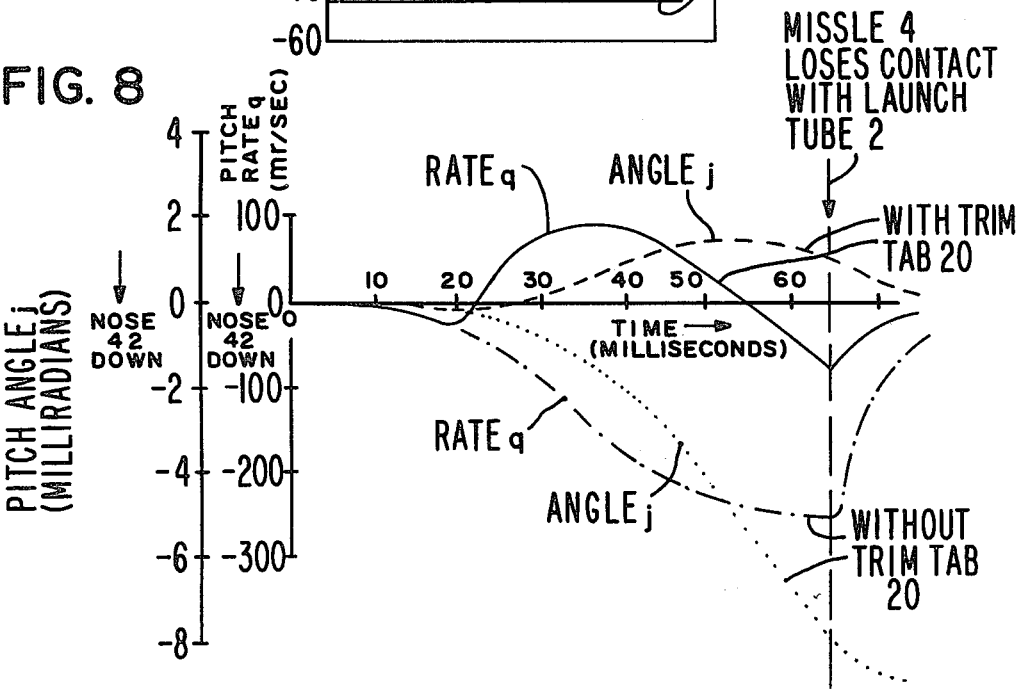
FIG. 8 is a graph illustrating pitch angle j; and q, the rate of change of angle j with respect to time, for two cases: when trim tab 20 is employed (corresponding to FIGS. 6 and 7) and when it is not employed.

There is a known quadratic relationship between x and time. Thus, if the above equation is integrated once to obtain q and integrated a second time to obtain j, q and j can be plotted as functions of time. This has been done in FIG. 8, for the case where a trim tab 20 is employed as well as for the same launch where a trim tab is not employed. After a short nose-down perturbation, tube 2 pitches nose-up because the nose-up trim tab 20 torque becomes larger than the nose-down gravitational torque. As missile 4 moves forward within tube 2, the gravitational torque increases until it overcomes the torque from tab 20. At the moment of exit of missile 4 from tube 2 (when the trailing edges of strakes 28 leave tube 2), q and j are near zero, q and j become zero after missile 4 exits tube 2 if a viscous damper is present in pitch pivot 16. These curves just described describe an acceptable performance of tube 2 pitch during launch. If tab 20 were not employed, tube 2 would undesirably point to the ground during launch, as illustrated in FIG. 8.

The above description is included to illustrate the operation of the preferred embodiments and is not meant to limit the scope of the invention. The scope of the invention is to be limited only by the following claims. From the above discussion, many variations will be apparent to one skilled in the art that would yet be encompassed by the spirit and scope of the invention. For example, more than one trim tab 20 can be employed at the rear of tube 2; the second such tab may or may not be aligned with the roll axis of tube 2.

What is claimed is:

1. An apparatus for launching a missile comprising:
   an elongated generally cylindrical hollow launch tube having open front and rear ends, said tube accommodating therewithin an elongated generally cylindrical missile to be launched therefrom;
   a single support for the tube, located generally at the center of mass thereof; and
   a stabilizing trim tab located within the launch tube near its rear end, the trim tab disposed to present a surface area to exhaust gases leaving the missile as it is launched, thereby producing a lift torque that balances the torque produced by gravity acting upon the missile as it travels within the tube during launch.

2. The apparatus of claim 1 wherein the trim tab has substantially the shape of an airfoil, with a substantially flat upper surface and an aerodynamically curved lower surface, a first end of the tab closer to the front of the tube being thicker than an opposing end of the tab closer to the rear of the tube.

3. The apparatus of claim 1 wherein the support enables the launch tube to pivot about the two orthogonal axes: a vertical yaw axis and a horizontal pitch axis that is orthogonal to the cylindrical axis of the launch tube.

4. The apparatus of claim 1 wherein the trim tab is offset from the cylindrical axis of the launch tube; and
   before the missile is launched, the center of mass of the missile is substantially aligned with the center of mass of the launch tube.

5. The apparatus of claim 1 wherein the time integral of lift torque attributable to the tab is substantially equal to the time integral of the gravitational torque.

6. The apparatus of claim 1 wherein the angle formed between the trim tab and the cylindrical axis of the launch tube, the surface area of the trim tab, and the distance between the trim tab and the center of mass of the combined tube and prelaunched missile are adjusted so that the lift torque caused by the missile's exhaust gases flowing over the tab balances the gravitational torque acting upon the missile as it travels through the tube.

7. The apparatus of claim 1 wherein the angle formed between the trim tab and the cylindrical axis of the launch tube, the surface area of the trim tab, and the distance between the trim tab and the center of mass of the combined prelaunched missile and launch tube are adjusted so that forward frictional forces and rearward exhaust-gas forces along the cylindrical axis of the launch tube are balanced as the missile is launched.

8. The apparatus of claim 7 wherein the angle formed between the trim tab and the cylindrical axis of the launch tube, the surface area of the trim tab, and the distance betrween the trib tab and the center of mass of the combined prelaunched missile and launch tube are adjusted so that the lift torque caused by the missile's exhaust gases flowing over the tab balances the gravitational torque acting upon the missile as it travels through the tube.

* * * * *

UNITED STATES PATENT AND TRADEMARK OFFICE

CERTIFICATE OF CORRECTION

PATENT NO. : 4,452,124

DATED : June 5, 1984

INVENTOR(S) : Richard C. Morenus and John T. Moore

It is certified that error appears in the above-identified patent and that said Letters Patent are hereby corrected as shown below:

In col. 6, line 62, delete "betrween" and insert in place thereof --between--.

In col. 6, line 62, delete "trib" and insert in place thereof --trim--.

Signed and Sealed this

*Ninth* Day of *October 1984*

[SEAL]

*Attest:*

GERALD J. MOSSINGHOFF

*Attesting Officer*

*Commissioner of Patents and Trademarks*